US008292296B2

(12) United States Patent
Eaton

(10) Patent No.: US 8,292,296 B2
(45) Date of Patent: Oct. 23, 2012

(54) APPARATUS FOR VARYING THE SPEED OF PRINTED PRODUCTS HAVING AN EXTERNAL ECCENTRIC ASSEMBLY AND METHOD

(75) Inventor: Jared Paul Eaton, Stratham, NH (US)

(73) Assignee: Goss International Americas, Inc., Durham, NH (US)

( * ) Notice: Subject to any disclaimer, the term of this patent is extended or adjusted under 35 U.S.C. 154(b) by 187 days.

(21) Appl. No.: 12/589,901

(22) Filed: Oct. 30, 2009

(65) Prior Publication Data

US 2011/0101604 A1 May 5, 2011

(51) Int. Cl.
*B65H 5/02* (2006.01)

(52) U.S. Cl. ..... 271/273; 271/270

(58) Field of Classification Search ..... 271/273, 271/270

See application file for complete search history.

(56) References Cited

U.S. PATENT DOCUMENTS

| | | | | | |
|---|---|---|---|---|---|
| 3,507,489 | A | * | 4/1970 | Bennett et al. | 271/182 |
| 3,623,720 | A | * | 11/1971 | Della Vite | 271/95 |
| 3,772,926 | A | | 11/1973 | Sidhu et al. | 74/116 |
| 4,601,387 | A | * | 7/1986 | Kobler | 198/626.1 |
| 4,898,373 | A | | 2/1990 | Newsome | |
| 5,102,111 | A | | 4/1992 | Reponty | |
| 5,265,861 | A | * | 11/1993 | Schaffner et al. | 271/182 |
| 5,417,416 | A | * | 5/1995 | Marmin et al. | 271/270 |
| 6,176,485 | B1 | | 1/2001 | Wingate | |
| 6,237,912 | B1 | | 5/2001 | Motooka et al. | |
| 6,302,391 | B1 | | 10/2001 | Robert | |
| 6,308,949 | B1 | * | 10/2001 | Ito et al. | 271/251 |
| 6,394,445 | B1 | | 5/2002 | D'Agrella et al. | |
| 6,428,001 | B1 | | 8/2002 | Jackson | |
| 6,543,767 | B1 | | 4/2003 | Krouse | |
| 6,572,097 | B2 | | 6/2003 | D'Agrella et al. | |
| 6,585,253 | B1 | * | 7/2003 | Miki | 271/125 |
| 6,612,213 | B1 | | 9/2003 | Bredenberg et al. | |
| 6,719,123 | B2 | | 4/2004 | Jackson et al. | |
| 6,913,257 | B2 | * | 7/2005 | Takaki et al. | 271/125 |
| 7,176,955 | B2 | * | 2/2007 | Tanabe | 347/215 |
| 7,686,300 | B2 | * | 3/2010 | Watanabe et al. | 271/251 |
| 2003/0221569 | A1 | | 12/2003 | Landskron et al. | |
| 2005/0067775 | A1 | * | 3/2005 | Ono | 271/272 |
| 2007/0102873 | A1 | * | 5/2007 | Acton et al. | 271/273 |
| 2008/0042340 | A1 | * | 2/2008 | Linder et al. | 271/274 |
| 2008/0289523 | A1 | | 11/2008 | Binder et al. | 101/348 |
| 2009/0295075 | A1 | * | 12/2009 | Inoue | 271/226 |

* cited by examiner

*Primary Examiner* — Michael McCullough
*Assistant Examiner* — Howard Sanders
(74) *Attorney, Agent, or Firm* — Davidson, Davidson & Kappel, LLC

(57) ABSTRACT

An apparatus for varying the speed of printed products is provided. The apparatus includes a nip roll rotatable about a nip roll axis and an eccentric assembly external of the nip roll coupled to the nip roll coincident with the nip roll axis. The eccentric assembly is adapted to eccentrically move the nip roll. A method of varying the speed of a printed product in a printing press is also provided.

20 Claims, 6 Drawing Sheets

APPARATUS FOR VARYING THE SPEED OF PRINTED PRODUCTS HAVING AN EXTERNAL ECCENTRIC ASSEMBLY AND METHOD

The present invention relates to an apparatus for varying the speed of printed products having an external eccentric assembly.

BACKGROUND

U.S. Pat. No. 6,302,391, which is hereby incorporated by reference herein, discloses an apparatus for varying the speed of flat products, wherein a copy is first engaged by high speed conveyor belts. The copy then passes through tension rollers while at the same time is taken over by liner sections of deceleration rollers where a trailing end of the copy leaves the nip between the tension rollers. Downstream of the nip, the high speed conveyor belts gradually diverge; the copy is no longer touched by high speed belts and can be braked by the liner sections, which cover part of the circumference of the deceleration rollers. The release of the copy by the deceleration rollers takes place at the same moment when the leading edge of the copy is engaged by the slow conveyor belts. The slow conveyor belt system is used to transport the copy to the second longitudinal folders. With this type of configuration, the deceleration rollers may be adjusted by moving the support for one of the deceleration rollers to modify the gap between the liner sections. This adjustment of the slow conveyor belt system also adjusts the accessibility to the high speed conveyor belts.

SUMMARY OF THE INVENTION

An apparatus for varying the speed of printed products is provided. The apparatus includes a nip roll rotatable about a nip roll axis and an eccentric assembly external of the nip roll coupled to the nip roll coincident with the nip roll axis. The eccentric assembly is adapted to eccentrically move the nip roll.

A method of varying the speed of a printed product is also provided. The method includes contacting a signature traveling at a first speed with nip rolls; eccentrically moving the nip rolls with eccentric assemblies that are external of the nip rolls; and releasing the signature from the nip rolls at a second speed.

BRIEF DESCRIPTION OF THE DRAWINGS

The present invention is described below by reference to the following drawings, in which.

DETAILED DESCRIPTION OF PREFERRED EMBODIMENTS

Figure 1:
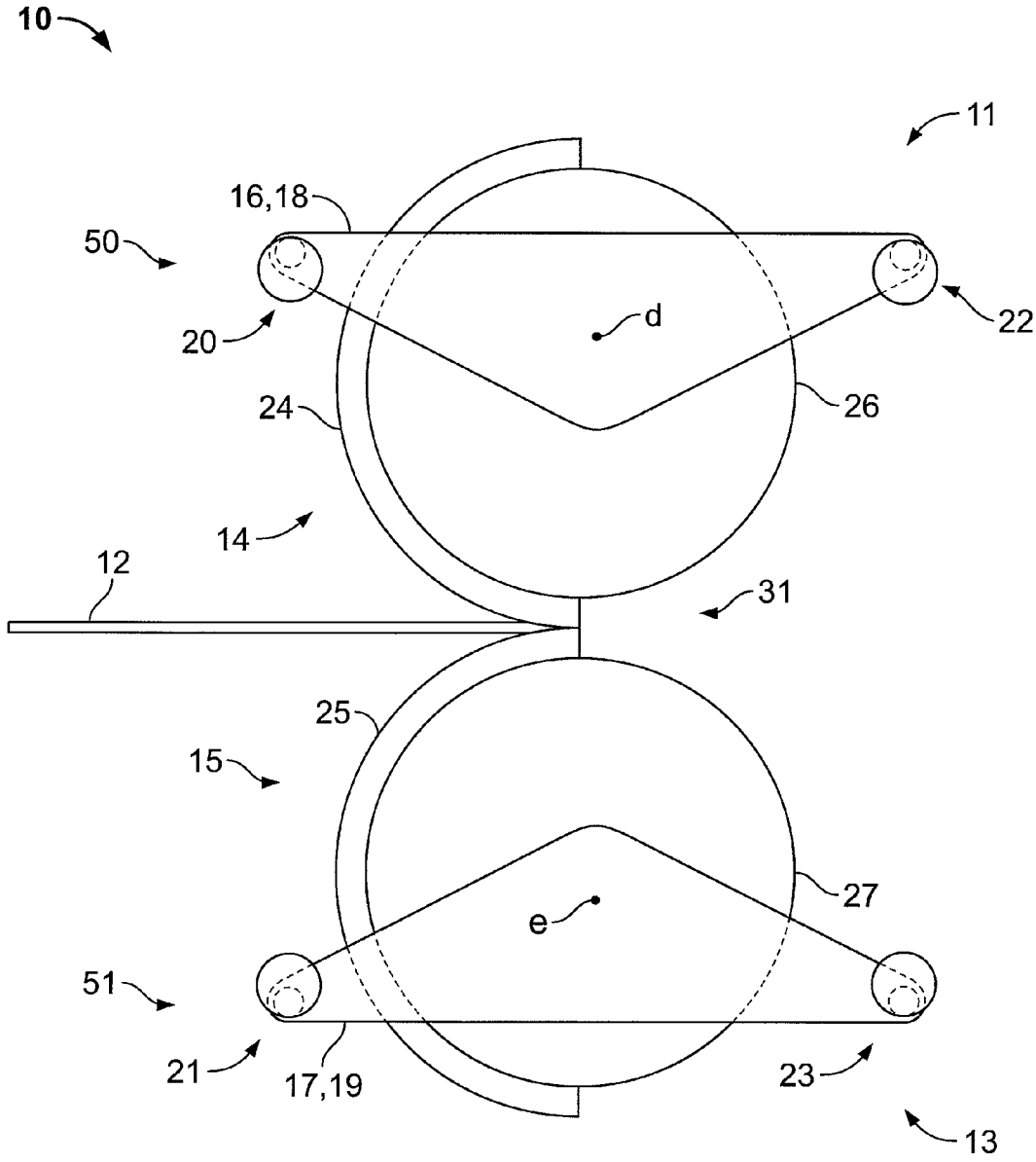
FIG. 1 schematically shows a side view of a signature velocity changing apparatus according to an embodiment of the present invention.

FIG. 1 shows a side view of a printed product velocity changing apparatus 10 according to an embodiment of the present invention, which may accelerate or decelerate printed products, such as signatures 12, in post process equipment in the graphics industry. For example, velocity changing apparatus 10 may be used in a folder similar to the folding system disclosed in incorporated by reference U.S. Pat. No. 6,302,391 B1 to decelerate or accelerate signatures. Apparatus 10 may include an upper section 11 and a lower section 13 that are substantially identical, in mirror image. Upper section 11 includes an upper roll 14 eccentrically rotatable about an axis d and an eccentric assembly 50 coupled to upper roll 14 coincident with axis d. Lower section 13 includes a lower roll 15 rotatable about an axis e and an eccentric assembly 51 coupled to lower roll 15 coincident with axis e. Eccentric assembly 50 includes two links 16, 18 and two external eccentric shafts 20, 22 and eccentric assembly 51 includes two links 17, 19 and two external eccentric shafts 21, 23. Each roll 14, 15 includes a respective nip segment 24, 25 and transporting signatures 12 at a nip 31 attached to an outer surface of a respective nip roll body 26, 27. Nip segments 24, 25 may each be formed by a single continuous material or two or more parallel strips of material.

Figure 2:
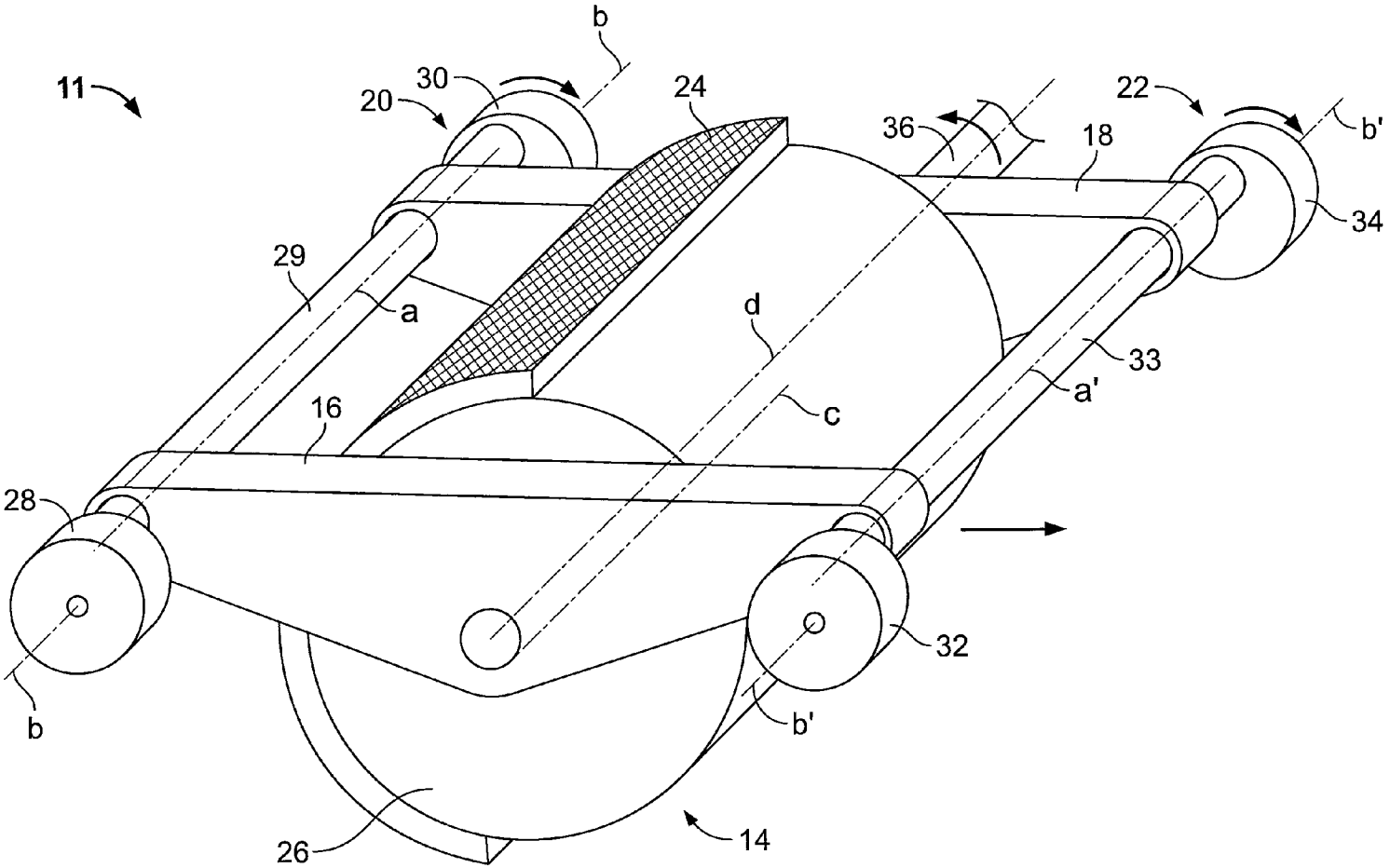
FIG. 2 schematically shows a perspective view of an upper section of the signature velocity changing apparatus shown in FIG. 1.

FIG. 2 shows a perspective view of upper section 11. Lower section 13 (FIG. 1) is configured in the same manner as upper section 11. External eccentric shaft 20 may include two end sections 28, 30 and an interior section 29 and external eccentric shaft 22 may include two end sections 32, 34 and an interior section 33. Links 16, 18 are coupled to both interior sections 29, 33. End sections 28, 30 are each concentrically rotatably coupled to support structures at an axis b. Interior section 29 is mounted eccentrically with respect to axis b, such that as shaft 20 is rotated about axis b, an axis a of interior section 29 orbits circularly about axis b. Similarly, end sections 32, 34 are each concentrically rotatably coupled to the support structures at an axis b' and interior section 33 is mounted eccentrically with respect to axis b', such that as shaft 22 is rotated about axis b', an axis a' of interior section 33 orbits circularly about axis b'. As a result of the connection between links 16, 18 and shafts 20, 22, links 16, 18 are also rotated in a circular orbit such that an axis d moves in the same manner as axes a, a'. Nip roll body 26 is eccentrically mounted with respect to axis d and a distance between axis d and a center axis C, which represents a geometric center of nip roll body 26 (i.e., center axis C is equidistant from an outer diameter of nip roll body 26), is equal to both a distance between axis a and axis b and a distance between axis a' and axis b'. Nip roll 14 is driven by a nip roll input shaft 36, which is coincident with axis d, at an angular velocity magnitude that is equal to an angular magnitude at which eccentric shafts 20, 22 are driven about respective axes b, b', but in the opposite direction. Input shaft 36 is rotatably coupled to both links 16, 18. A drive of nip roll 14 is configured to accommodate the orbital translation of axis d, and for example, may include a 3-plane Schmidt coupling and be configured similar to a drive arrangement 200 shown in FIG. 6.

During one complete revolution of nip roll 14 about axis d, which coincides with one complete revolution of eccentric shaft 20 about axis a and one complete revolution of eccentric shaft 22 about axis a', a linear velocity variation of the outer surface of nip segment 24 has a course represented by one complete sinusoidal curve, which has a maximum value and a minimum value. Depending on the phasing of nip roll 14, nip segment 24 may first contact passing signature 12 (FIG. 1) when the velocity of the outer surface of nip segment 24 is at a maximum value and then decelerate signature 12 (FIG. 1) as the velocity of the outer surface of nip segment 24 approaches the minimum value. Alternatively, nip segment 24 may first contact passing signature 12 (FIG. 1) when the velocity of the outer surface of nip segment 24 is at a minimum value and then accelerate signature 12 (FIG. 1) as the velocity of the outer surface of nip segment 24 approaches the maximum value.

Figure 3A:
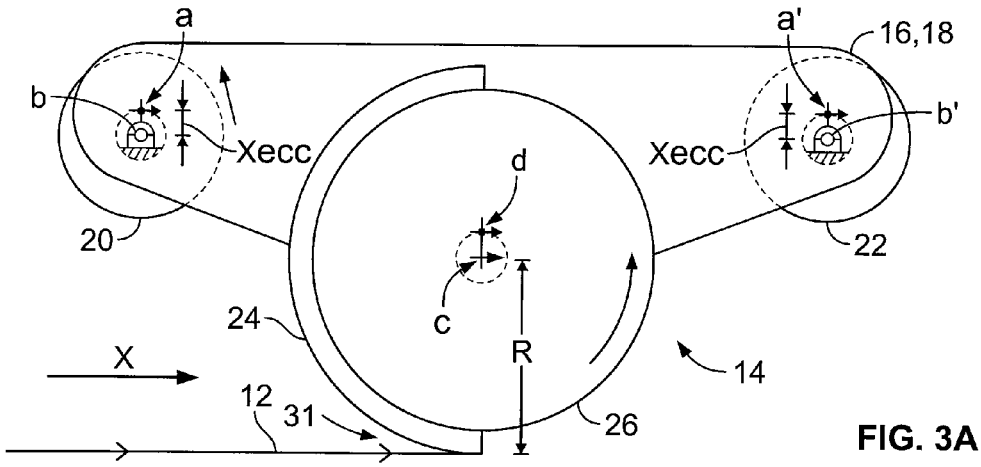
FIGS. 3*a* to 3*c* schematically show a progression of the upper section of the signature velocity changing apparatus shown in FIGS. 1 and 2 contacting and decelerating a signature.
Figure 3B:
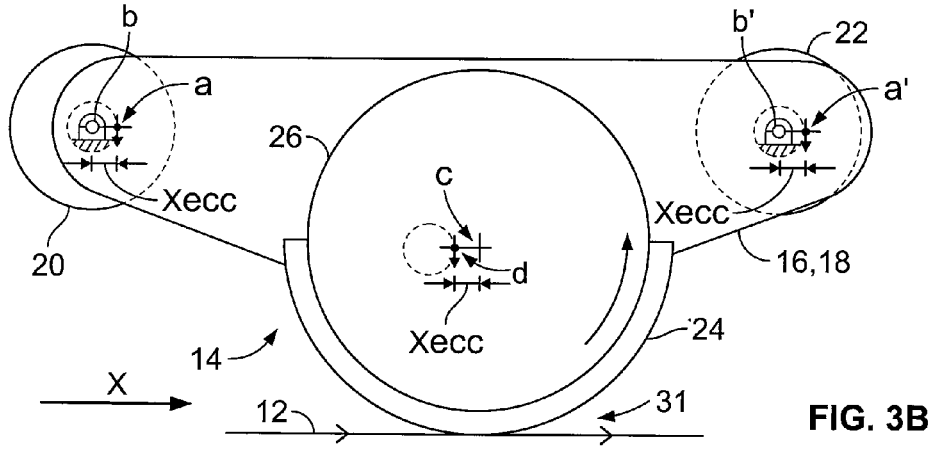
Figure 3C:
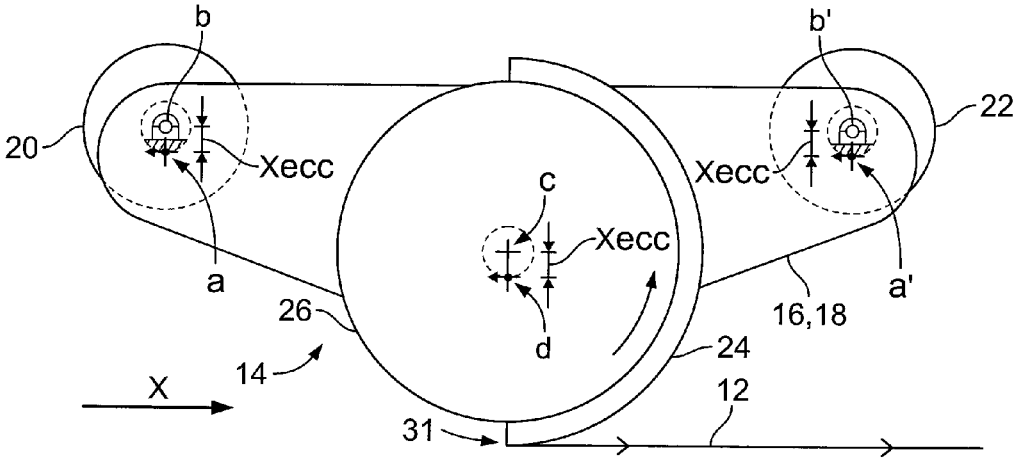

FIGS. 3*a* to 3*c* schematically show upper section 11 of signature velocity changing apparatus 10 contacting and decelerating signature 12. Lower section 13 (FIG. 1) operates opposite of signature 12 from upper section 11 in a manner that is a mirror image of upper section 11 for decelerating signature 12. In FIGS. 3*a* to 3*c*, nip roll 14 is rotated in one direction, i.e., counterclockwise, by shaft 36 (FIG. 2) at an angular velocity magnitude ω, while eccentric shafts 20, 22 are rotated in the opposite direction, i.e., clockwise, at the same angular velocity magnitude ω. Eccentric shafts 20, 22 and nip roll 14 also have the same eccentricity Xecc. A phasing between eccentric shafts 20, 22 and nip roll 14 is set so that a velocity Vn of nip segment 24 in the X-direction at nip 31 is at a maximum value in FIG. 3*a* and at a minimum value in FIG. 3*c*. The phasing also maintains a constant nip elevation at the point of contact of nip segment 24 with signature 12 as nip segment 24 passes nip 31, such that vertical motions of the two eccentric components, nip roll 14 and eccentric shafts 20, 22, cancel each other out. As a result, center axis C is not translated in the vertical direction as signature 12 is decelerated.

FIG. 3*a* shows upper section 11 as nip segment 24 comes into contact with signature 12. Axes a, a' are directly above respective axes b, b' and axis d is directly above center axis C. In the position shown in FIG. 3*a*, eccentric shafts 20, 22 are translating axes a, a', d in the X-direction at a velocity Va that is equal to an angular velocity magnitude ω of shafts 20, 22 multiplied by an eccentricity Xecc of eccentric shafts 20, 22 (Va=ω*Xecc). Meanwhile, nip roll 14 is also being rotated by shaft 36 (FIG. 2) about axis d at angular velocity magnitude ω so that center axis C, relative to axis d, is translating in the X-direction at a velocity Vca equal to angular velocity magnitude ω of shaft 36 (FIG. 2) multiplied by eccentricity Xecc of nip roll 14 (Vca=ω*Xecc). A net velocity Vc of center axis C in the X-direction is equal to velocity Va of axes a, a', d plus velocity Vca of center axis C relative to axis d, which equals two multiplied by angular velocity magnitude ω multiplied by eccentricity Xecc (Vc=Va+Vca=2*ω*Xecc). A velocity Vn of nip segment 24 in the X-direction at nip 31 is then equal to a radius R of nip roll 14 multiplied by angular velocity magnitude ω of nip roll 14 plus net velocity Vc of center axis C (Vn=R*w+2*ω*Xecc).

FIG. 3*b* shows upper section 11 in the middle of decelerating signature 12. From FIG. 3*a* to FIG. 3*b*, nip roll 14 is rotated ninety degrees counterclockwise about axis d and eccentric shafts 20, 22, and respective axes a, a', are rotated ninety degrees clockwise about respective axes b, b'. Axis d is rotated ninety degrees clockwise in a circular orbit by eccentric shafts 20, 22 while center axis C is rotated ninety degrees counter clockwise about axis d by shaft 36 (FIG. 2). In the position shown in FIG. 3*b*, axes a, a', d are only translating downwardly, not in the X-direction, and center axis C is only translating upwardly with respect to axis d, not in the X-direction. As a result, net velocity Vc of center axis C is zero in the X-direction and velocity Vn of nip segment 24 at nip 31 is equal to radius R of nip roll 14 multiplied by angular velocity magnitude ω of nip roll 14 (Vn=R*ω).

FIG. 3*c* shows upper section 11 at the end of decelerating signature 12, with nip segment 24 releasing signature 12. From FIG. 3*b* to FIG. 3*c*, nip roll 14 is rotated ninety degrees counterclockwise about axis d and eccentric shafts 20, 22 and respective axes a, a' are rotated ninety degrees clockwise about respective axes b, b'. In the position shown in FIG. 3*c*, eccentric shafts 20, 22 are translating axes a, a', d away from the X-direction, such that a velocity Va is a negative value equal to an angular velocity magnitude ω of shafts 20, 22 multiplied by an eccentricity Xecc of eccentric shafts 20, 22 (Va=−ω*Xecc). Meanwhile, nip roll 14 is also being rotated by shaft 36 (FIG. 2) about axis d at angular velocity magnitude ω so that center axis C is translating away from the X-direction, such that a velocity Vca of center axis C relative to axis d is a negative value equal to angular velocity magnitude ω of shaft 36 (FIG. 2) multiplied by eccentricity Xecc of nip roll 14 (Vca=−ω*Xecc). A net velocity Vc of center axis C in the X-direction is a negative value is equal to velocity Va of axes a, a', d plus velocity Vca of center axis C relative to axis d, which equals two multiplied by angular velocity magnitude ω multiplied by eccentricity Xecc (Vc=Va+Vca=−2*ω*Xecc). A velocity Vn of nip segment 24 in the X-direction at nip 31 is then at a minimum value that is equal to radius R of nip roll 14 multiplied by angular velocity magnitude ω of nip roll 14 plus net velocity Vc of center axis C, which is a negative value (Vn=R*ω−2*ω*Xecc).

Figure 4A:
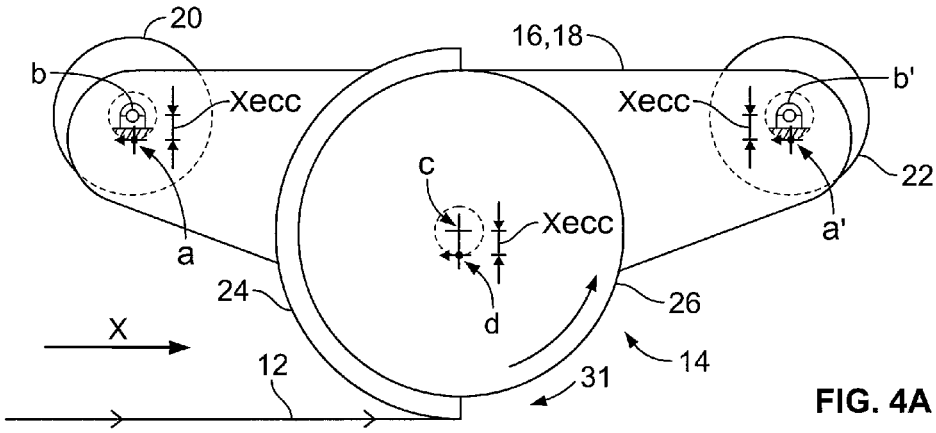
FIGS. 4*a* to 4*c* schematically show a progression of the upper section of the signature velocity changing apparatus shown in FIGS. 1 and 2 contacting and accelerating a signature.
Figure 4B:
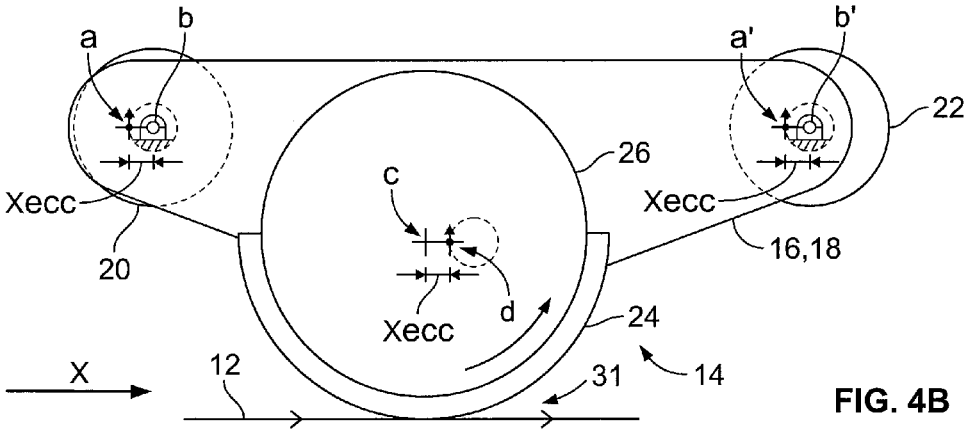
Figure 4C:
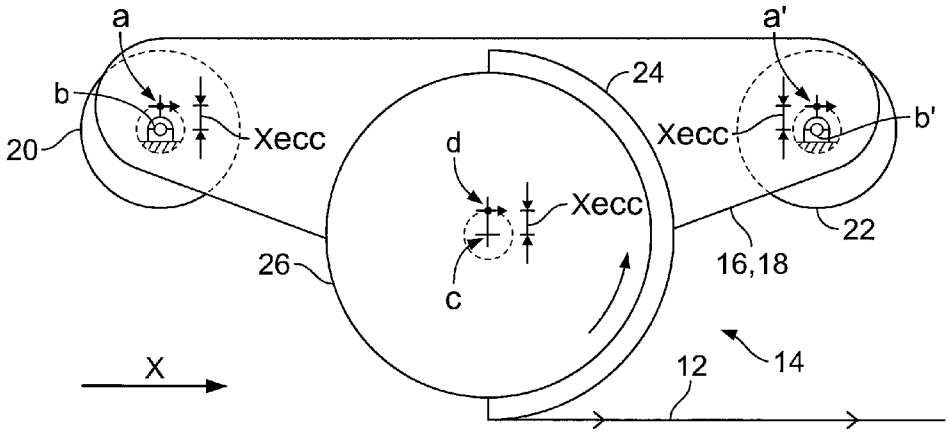

FIGS. 4*a* to 4*c* schematically show upper section 11 of signature velocity changing apparatus 10 contacting and accelerating signature 12. Lower section 13 (FIG. 1) operates opposite of signature 12 from upper section 11 in a manner that is a mirror image of upper section 11 for accelerating signature 12. In FIGS. 4*a* to 4*c*, nip roll 14 is rotated counterclockwise, while eccentric shafts 20, 22 are rotated clockwise. A phasing between eccentric shafts 20, 22 and nip roll 14 is set so that a velocity Vn of nip segment 24 in the X-direction at nip 31 is at a minimum value in FIG. 4*a* and at a maximum value in FIG. 4*c*. During the acceleration of signature 12, similar to the deceleration of signature shown in FIGS. 3*a* to 3*c*, the phasing also maintains a constant nip elevation at the point of contact of nip segment 24 with signature 12 as nip segment 24 passes nip 31, such that vertical motions of the two eccentric components, nip roll 14 and eccentric shafts 20, 22, cancel each other out. As a result, center axis C is not translated in the vertical direction as signature 12 is accelerated.

FIG. 4*a* shows upper section 11 just as nip segment 24 comes into contact with signature 12. Axes a, a' are directly below respective axes b, b' and axis d is directly below center axis C. In the position shown in FIG. 4*a*, eccentric shafts 20, 22 are translating axes a, a', d away from the X-direction, such that a velocity Va is a negative value equal to an angular velocity magnitude ω of shafts 20, 22 multiplied by eccentricity Xecc of eccentric shafts 20, 22 (Va=−ω*Xecc). Meanwhile, nip roll 14 is also being rotated by shaft 36 (FIG. 2) about axis d at angular velocity magnitude ω so that center axis C is translating away from the X-direction. Center axis C is translating relative to axis d at velocity Vca that is a negative value equal to angular velocity magnitude ω of shaft 36 (FIG. 2) multiplied by eccentricity Xecc of nip roll 14 (Vca=−ω*Xecc). Net velocity Vc of center axis C in the X-direction is a negative value equal to velocity Va of axes a, a', d plus velocity Vca of center axis C relative to axis d, which equals two multiplied by angular velocity magnitude ω multiplied by eccentricity Xecc (Vc=Va+Vca=−2*ω*Xecc). A velocity Vn of nip segment 24 in the X-direction at nip 31 is then at a minimum value that is equal to radius R of nip roll 14 multiplied by angular velocity magnitude ω of nip roll 14 plus net velocity Vc of center axis C, which is a negative value (Vn=R*ω−2*ω*Xecc).

FIG. 4*b* shows upper section 11 in the middle of accelerating signature 12. From FIG. 4*a* to FIG. 4*b*, nip roll 14 is rotated ninety degrees counterclockwise about axis d and eccentric shafts 20, 22, and respective axes a, a', are rotated ninety degrees clockwise about respective axes b, b'. Axis d is rotated ninety degrees clockwise in a circular orbit by eccentric shafts 20, 22 while center axis C is rotated ninety degrees counter clockwise about axis d by shaft 36 (FIG. 2). In the position shown in FIG. 4*b*, axes a, a', d are only translating downwardly, not in the X-direction, and center axis C is only translating upwardly with respect to axis d, not in the X-direction. As a result, net velocity Vc of center axis C is zero in the X-direction and velocity Vn of nip segment 24 at nip 31 is equal to radius R of nip roll 14 multiplied by angular velocity magnitude ω of nip roll 14 (Vn=R*ω).

FIG. 4*c* shows upper section 11 at the end of accelerating signature 12, with nip segment 24 releasing signature 12. From FIG. 4*b* to FIG. 4*c*, nip roll 14 is rotated ninety degrees counterclockwise about axis d and eccentric shafts 20, 22, and respective axes a, a', are rotated ninety degrees clockwise about respective axes b, b'. In the position shown in FIG. 4*c*, eccentric shafts 20, 22 are translating axes a, a', d in the X-direction at a velocity Va that is equal to an angular velocity magnitude ω of shafts 20, 22 multiplied by an eccentricity Xecc of eccentric shafts 20, 22 (Va=ω*Xecc). Meanwhile, nip roll 14 is also being rotated by shaft 36 (FIG. 2) about axis d at angular velocity magnitude ω so that center axis C is translating in the X-direction with respect to axis d at a velocity Vca that is equal to angular velocity magnitude ω of shaft 36 (FIG. 2) multiplied by eccentricity Xecc of nip roll 14 (Vca=ω*Xecc). Net velocity Vc of center axis C in the X-direction is equal to velocity Va of axes a, a', d plus velocity Vca of center axis C relative to axis d, which equals two multiplied by angular velocity magnitude ω multiplied by eccentricity Xecc (Vc=Va+Vca=2*ω*Xecc). A velocity Vn of nip segment 24 in the X-direction at nip 31 is then equal to a radius R of nip roll 14 multiplied by angular velocity magnitude ω of nip roll 14 plus net velocity Vc of center axis C (Vn=R*ω+2*ω*Xecc).

Figure 5:
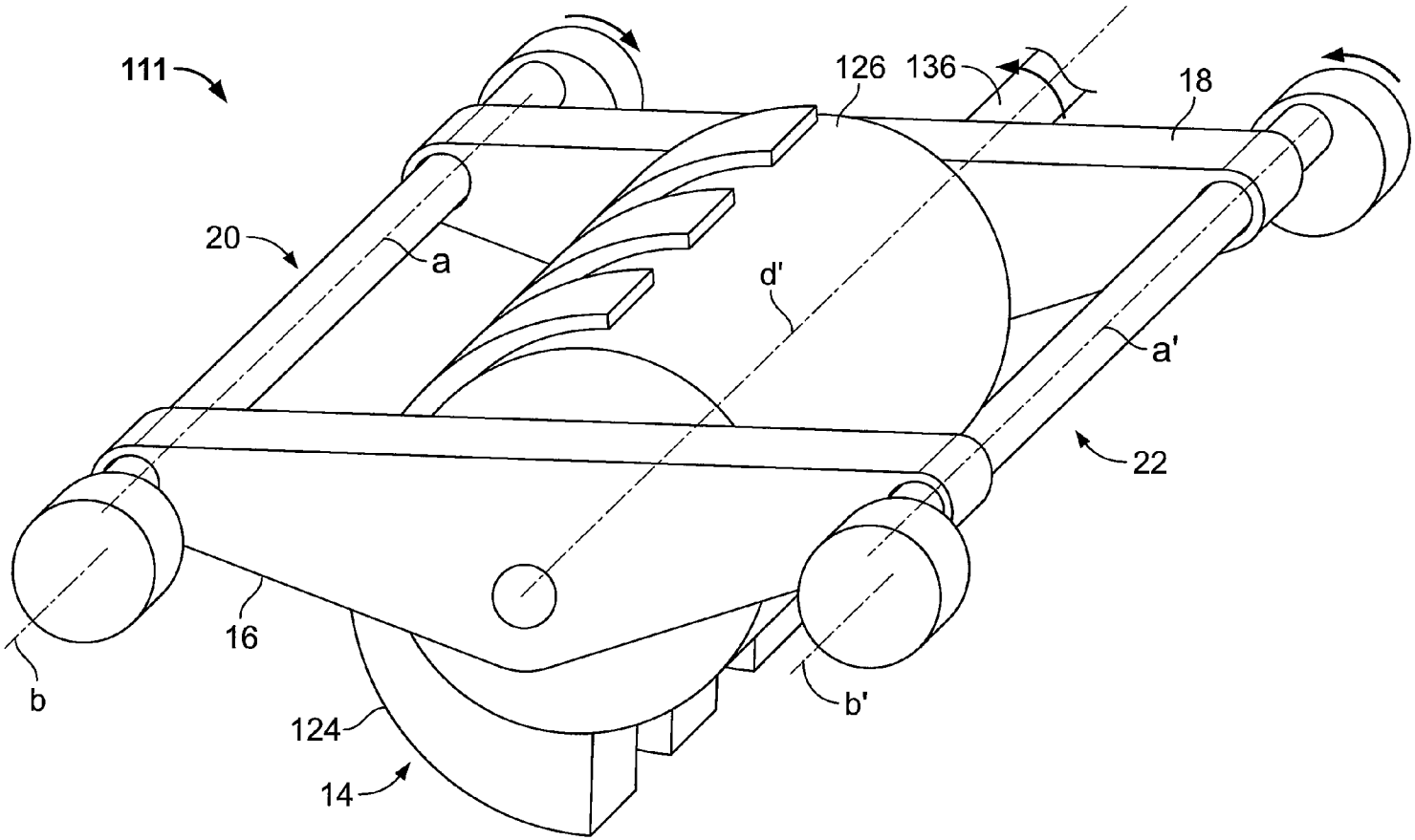
FIG. 5 schematically shows a perspective view of an upper section of a signature velocity changing apparatus according to another embodiment of the present invention.

FIG. 5 shows an upper section 111 of a signature velocity changing apparatus according to another embodiment of the present invention. Upper section 111 includes eccentric shafts 20, 22 and links 16, 18 that are configured in the same manner as in FIGS. 1 to 4*c*, with axes a, a' circularly orbiting respective axes b, b' during operation. Upper section 111 also includes a nip roll 114 that includes a nip roll body 126 and nip segments 124 for contacting signatures. Nip roll 114 is driven by a shaft 136 about an axis d'. Shaft 136 is rotatably coupled to links 16, 18, so shaft 136 can rotate about axis d' as eccentric shafts 20, 22 cause shaft 136 to rotate in a circular orbit. Roll body 126 is concentrically mounted on shaft 136 about axis d'. Nip segments 124 are contoured to correspond to the eccentric movement that is translated to nip roll 114 via links 16, 18. Nip segments 124 have a varying thickness, such that even though roll body 126 is concentrically mounted, nip segments can maintain contact with and accelerate or decelerate signatures that enter a nip formed between upper section 111 and a corresponding lower section that is configured similar to upper section 111, in mirror image.

Figure 6:
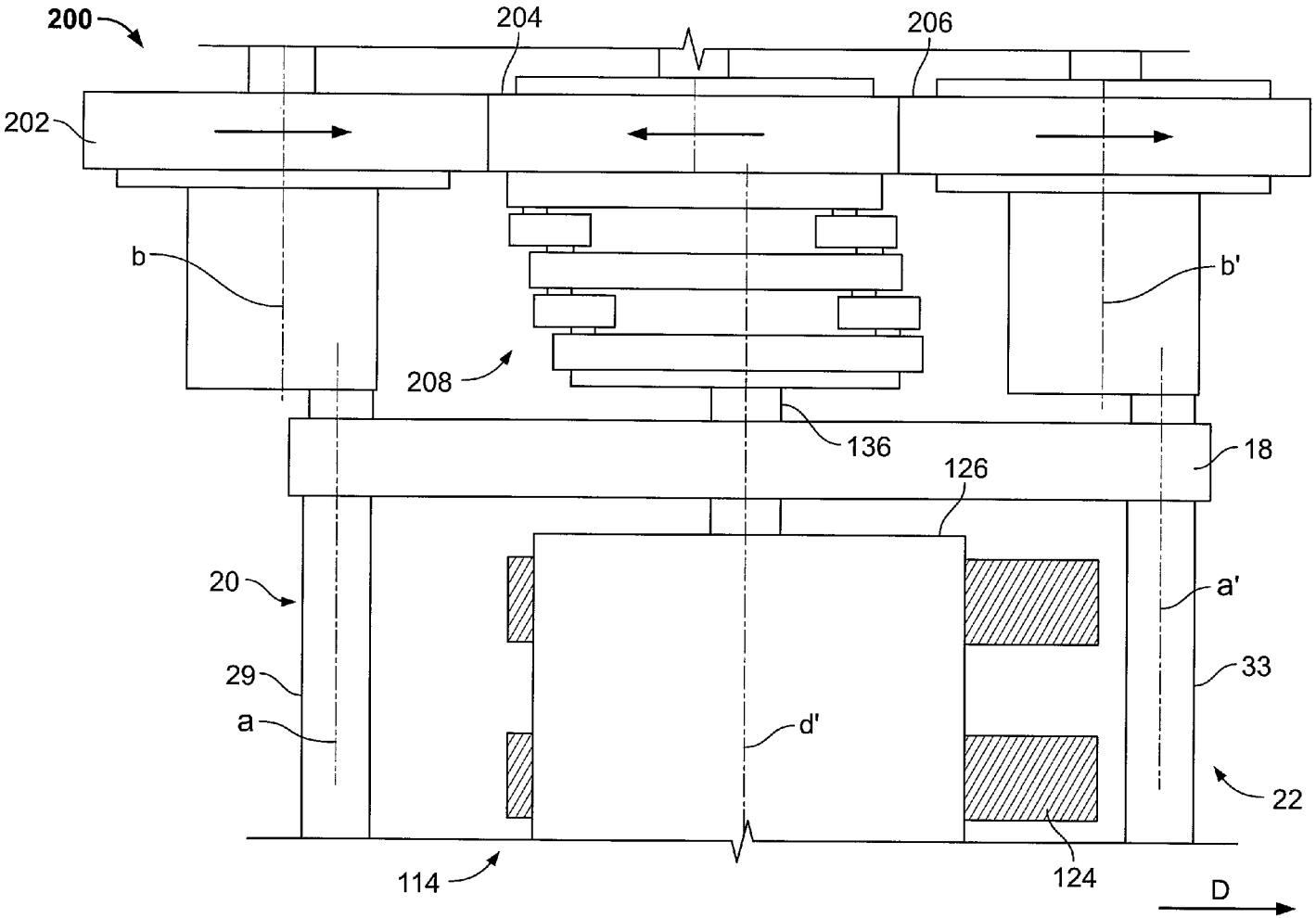
FIG. 6 shows a drive arrangement for driving the upper section shown in FIG. 5.

FIG. 6 shows a drive arrangement 200 for driving upper section 111 according to an embodiment of the present invention. A gear 202 drives external eccentric shaft 20 so that axis a of interior section 29 orbits about axis b. A gear 204 intermeshed with gear 202 is also driven by gear 202. Gear 204 drives roll body 126 about axis d'. A gear 206 intermeshed with gear 204 is also driven by gear 204. Gear 206 drives external eccentric shaft 22 so that axis a' of interior section 33 orbits about axis b'. Gears 202, 204, 206 all have stationary centers and have a common diameter, with gears 202 and 206 rotating in one direction and gear 204 in an opposite direction. A Schmidt coupling 208 is employed between gear 204 and shaft 136 to drive nip roll 114 about axis d'. Schmidt coupling 208 allows gear 204 to rotate shaft 136 as shaft 136 is translated in a circular orbit by links 16 (FIG. 5), 18. Nip segments 124 transport signatures in a direction D. In an alternative embodiment, a ring and sun gear arrangement may be used in place of Schmidt coupling 208. Drive arrangement 200 may also be used to drive upper section 11 shown in FIGS. 1 to 4*c*.

In the disclosed embodiments of the signature velocity changing apparatus, eccentric shafts 20, 22 are located external of nip rolls 14, 15, 114, where there is more space and less geometric constraints. Less geometric constraints may advantageously allow the disclosed embodiments to be used to accelerate and decelerate signature of small cutoffs. The disclosed embodiments may advantageously provide increased durability and decreased cost, where off-the-shelf components can be used.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. An apparatus for varying the speed of printed products comprising:

a nip roll eccentrically mounted with respect to a nip roll axis of the nip roll, the nip roll rotatable a complete revolution about the nip roll axis; and an eccentric assembly external of the nip roll coupled to the nip roll coincident with the nip roll axis, the eccentric assembly being eccentrically mounted with respect to at least one axis of the eccentric assembly such that the eccentric assembly is adapted to move the nip roll such that the nip roll axis follows an orbital path as the nip roll rotates the complete revolution about the nip roll axis.

2. The apparatus recited in claim 1 wherein the eccentric assembly includes at least one link coupled to the nip roll coincident with the nip roll axis and at least one eccentric shaft adapted to eccentrically move the at least one link.

3. The apparatus recited in claim 2 wherein the at least one eccentric shaft includes two end portions concentrically rotatable about a first shaft axis.

4. The apparatus recited in claim 2 wherein the at least one link includes a first link and a second link, a first axial end of the nip roll being rotatably coupled to the first link and a second axial end of the nip roll being rotatably coupled to the second link.

5. The apparatus recited in claim 4 wherein the at least one eccentric shaft includes a first eccentric shaft coupled to the first and second links and a second eccentric shaft coupled to the first and second links.

6. The apparatus as recited in claim 2 wherein the at least one eccentric shaft rotates a complete revolution in a first direction as the nip roll rotates a complete rotation in a second direction opposite the first direction.

7. The apparatus recited in claim 1 further comprising a drive coupled to the nip roll for rotating the nip roll in a first direction about the nip roll axis, the eccentric assembly moving the nip roll axis in a circular orbit in a second direction that is opposite the first direction.

8. The apparatus recited in claim 7 wherein the drive is also coupled to the eccentric assembly and is adapted to drive the eccentric assembly.

9. The apparatus recited in claim 1 wherein the nip roll is eccentrically mounted with respect to the nip roll axis.

10. The apparatus recited in claim 9 wherein the nip roll includes a nip roll body and a nip roll segment secured to the nip roll body, the nip roll segment having a constant thickness.

11. The apparatus recited in claim 1 wherein the nip roll is concentrically mounted with respect to the nip roll axis.

12. The apparatus recited in claim 11 wherein the nip roll includes a nip roll body and a nip roll segment secured to the nip roll body, the nip roll segment having an increasing thickness.

13. The apparatus recited in claim 1 further comprising a second nip roll rotatable about a second nip roll axis contacting the nip roll and forming a nip.

14. The apparatus recited in claim 13 further comprising a second eccentric assembly external of the second nip roll coupled to the second nip roll coincident with the second nip roll axis, the second eccentric assembly adapted to eccentrically move the second nip roll.

15. The apparatus as recited in claim 13 wherein the first and second nip rolls are configured to receive a signature at the nip at a first velocity and release the signature from the nip at a second velocity different from the first velocity, the surfaces of the first and second nip rolls contacting the signature.

16. An apparatus for varying the speed of printed products comprising:

a nip roll rotatable about a nip roll axis; and an eccentric assembly external of the nip roll coupled to the nip roll coincident with the nip roll axis, the eccentric assembly adapted to eccentrically move the nip roll;

wherein the eccentric assembly includes at least one link coupled to the nip roll coincident with the nip roll axis and at least one eccentric shaft adapted to eccentrically move the at least one link;

wherein the at least one eccentric shaft includes two end portions concentrically rotatable about a first shaft axis;

wherein the at least one eccentric shaft further includes an internal portion coupled between the two end portions, the internal portion having a second shaft axis that orbits the first shaft axis as the two end portions rotate about the first shaft axis.

17. A method of varying the speed of a printed product comprising:

contacting a signature traveling at a first speed with a first nip roll and a second nip roll;

eccentrically moving the first nip roll with a first eccentric assembly external to the first nip roll and eccentrically moving the second nip roll with a second eccentric assembly external to the second nip roll, the first eccentric assembly including at least one first eccentric shaft extending along a length of the first nip roll, the second eccentric assembly including at least one second eccentric shaft extending along a length of the first nip roll, the eccentrically moving the first nip roll including eccentrically moving the at least one first eccentric shaft in a circular orbit, the eccentrically moving the second nip roll including moving the at least one second eccentric shaft in a circular orbit; and releasing the signature from the first and second nip rolls at a second speed.

18. The method recited in claim 17 wherein a first axis of the first nip roll and a second axis of the second nip roll move towards and way from each other during the eccentrically moving of the first nip roll and the eccentrically moving of the second nip roll.

19. The method recited in claim 17 wherein the first nip roll includes a first internal shaft connected to the first nip roll and the second nip roll includes a second internal shaft connected to the second nip roll, the eccentrically moving the first nip roll including rotating the first internal shaft and the at least one first eccentric shaft in opposite directions, the eccentrically moving the second nip roll including rotating the second internal shaft and the at least one second eccentric shaft in opposite directions.

20. The method as recited in claim 19 wherein the at least one first eccentric shaft includes two first eccentric shafts on opposite sides of the first nip roll and the at least one second eccentric shaft includes two second eccentric shafts on opposite sides of the second nip, the eccentrically moving the first nip roll including eccentrically moving the two first eccentric shafts in circular orbits, the eccentrically moving the second nip roll including moving the two second eccentric shafts in circular orbits.

* * * * *